US010283234B2

(12) United States Patent
Eicher et al.

(10) Patent No.: US 10,283,234 B2
(45) Date of Patent: May 7, 2019

(54) METHOD FOR DIELECTRICALLY INSULATING ACTIVE ELECTRIC PARTS

(71) Applicant: SOLVAY SA, Brussels (BE)

(72) Inventors: Johannes Eicher, Sehnde (DE); Holger Pernice, Schwanewede (DE); Marc Lacroix, Louvain-la-neuve (BE); Thomas Schwarze, Ahlten (DE); Sebastian Hasenstab-Riedel, Kleinmachnow (DE)

(73) Assignee: SOLVAY SA, Brussels (BE)

( * ) Notice: Subject to any disclaimer, the term of this patent is extended or adjusted under 35 U.S.C. 154(b) by 470 days.

(21) Appl. No.: 14/653,524

(22) PCT Filed: Dec. 20, 2013

(86) PCT No.: PCT/EP2013/077825
§ 371 (c)(1),
(2) Date: Jun. 18, 2015

(87) PCT Pub. No.: WO2014/096414
PCT Pub. Date: Jun. 26, 2014

(65) Prior Publication Data

US 2015/0318079 A1 Nov. 5, 2015

(30) Foreign Application Priority Data

Dec. 21, 2012 (EP) ..... 12199091

(51) Int. Cl.
*H01B 3/56* (2006.01)
*H01B 19/04* (2006.01)

(52) U.S. Cl.
CPC ..... *H01B 3/56* (2013.01); *H01B 19/04* (2013.01); *Y10T 29/49229* (2015.01)

(58) Field of Classification Search
CPC ... H01B 3/00; H01B 3/02; H01B 3/56; H01B 19/04; H02B 7/01; H02B 13/035; H02B 13/055; Y10T 29/49229
See application file for complete search history.

(56) References Cited

U.S. PATENT DOCUMENTS 3,150,245 A * 9/1964 Baker ..... H01H 33/22 218/112
4,136,121 A * 1/1979 Martini ..... C07C 45/48 549/378
4,175,048 A * 11/1979 Christophorou ..... H02B 13/055 174/137 B
4,288,651 A * 9/1981 Wootton ..... H01B 3/16 174/17 GF
4,296,003 A 10/1981 Harrold et al.
4,391,940 A * 7/1983 Kuhls ..... C08F 259/08 523/201
5,399,718 A * 3/1995 Costello ..... C07B 39/00 549/266
5,466,877 A * 11/1995 Moore ..... C07C 45/54 562/852
5,605,882 A 2/1997 Klug et al.
6,478,979 B1 * 11/2002 Rivers ..... A62D 1/0085 169/46
2004/0056234 A1 * 3/2004 Belt ..... B01F 3/026 252/372
2005/0127322 A1 * 6/2005 Costello ..... C09K 5/10 252/71
2008/0135817 A1 * 6/2008 Luly ..... H01B 3/56 252/571
2012/0145521 A1 * 6/2012 Glasmacher ..... H02B 13/055 200/293
2012/0152904 A1 * 6/2012 Hyrenbach ..... H01B 3/56 218/118
2013/0265692 A1 10/2013 Mahdizadeh et al.

FOREIGN PATENT DOCUMENTS

WO 2010/146022 A1 * 12/2010
WO 2012080222 A1 6/2012

OTHER PUBLICATIONS

Donald E. Clark, "Peroxides and peroxide-forming compounds", Chemical Health & Safety, Sep./Oct. 2001, pp. 12-22.

* cited by examiner

*Primary Examiner* — Carl J Arbes

(57) ABSTRACT

A method for dielectrically insulating active electric parts A method for dielectrically insulating an active electric part wherein the electrical active part is arranged in a gas-tight housing comprising an insulating gas which contains or consists of a compound of formula (i) Rf1-(O)x-Rf2 wherein Rf1 and Rf2 are identical or different and designated fluorocarbon residues having a H/F ratio of equal to or less than 0.5 and x is 1, 2, or 3.

18 Claims, No Drawings

METHOD FOR DIELECTRICALLY INSULATING ACTIVE ELECTRIC PARTS

This application is a U.S. national stage entry under 35 U.S.C. § 371 of International Application No. PCT/EP2013/077825 filed Dec. 20, 2013, which claims priority to European application 12199091.5 filed on 21 Dec. 2012. The entire contents of these applications are explicitly incorporated herein by this reference.

The invention concerns a method for dielectrically insulating active electric parts a dielectric insulation medium comprising certain oxygenated fluorocompounds, certain such compounds per se and the use of such compounds as a component in a dielectric insulating medium.

Dielectric insulation media in liquid or gaseous state are applied for the insulation of electrical active parts in a wide variety of electrical apparatuses, e.g. in switchgears or transformers.

Mixtures of $SF_6$ and $N_2$ are widely applied as dielectric insulating gas. Efforts have been made in the past to provide alternative dielectric insulating gases.

US-A-2008/0135817 relates to the problem of SF6 substitution. While it mentions CF3-O—O—CF3 as a speculative substitute in a long very diverse list of other compounds, no specific technical information concerning its use is given and working examples only relate to use of certain hydrofluoroalkanes or of SiF4.

The object of the present invention is to provide an improved for electrical insulation of electrical active parts. This object and other objects are achieved by the current invention.

The method of the present invention provides for a method for dielectrically insulating an active electric part wherein the electrical active part is arranged in a gas-tight housing comprising an insulating gas which contains or consists of a compound of formula $$Rf1\text{-}(O)x\text{-}Rf2 \qquad (I)$$

wherein Rf1 and Rf2 are identical or different and designated fluorocarbon residues having a H/F ratio of equal to or less than 0.5 and x is 1, 2, or 3 and wherein the content of compound of formula (I) in the insulating gas is preferably equal to or greater than 1% by volume relative to the volume of the insulating gas.

Compounds of formula (I)° can be manufactured for example by reaction of a fluorinated hypofluorite, such as CF3OF with COF2, for example as described in US-A-2007/0049774. Compounds of formula (I) with x=3 can be manufactured, for example, as described in Angew. Chem. Int. Ed. English 34(20), p. 2244-5.

Generally, in the method according to the invention, compounds wherein Rf1 and Rf2 contain independently from 1 to 3 carbon atoms can be suitably used.

In the method according to the invention, the compound of formula (I) has an generally an atmospheric boiling point of less than 20° C., preferably equal to or lower than 0° C. preferably equal to or less than −10° C. In the method of according to the invention, the compound of formula (I) has an generally an atmospheric boiling point of equal to or higher than −80° C., preferably equal to or higher than −50° C.

In a preferred aspect of the method according to the invention the compound of formula (I) is perfluorinated. In this case, Rf1 and Rf2 are often independently selected from methyl, ethyl, n-propyl and isopropyl. Preferred compounds of formula (I) are selected from CF3-O—CF3, CF3-O—O—CF3 and CF3-O—O—O—CF3, CF3-O—O—CF3 is more particularly preferred.

In another aspect of the method according to the invention the compound of formula (I) is not perfluorinated. In this case, Rf1 and Rf2 are often independently selected from difluoromethyl, tetrafluoroethyl, n-hexafluoropropyl and isohexafluoropropyl, preferably difluoromethyl.

The term "electrical active part" has to be understood very broadly. Preferably, it covers any part which is used for the generation, the distribution or the usage of electrical energy provided it comprises a gas-tight housing wherein the dielectric insulating gas provides for the dielectric insulation of parts which bear voltage or current. Preferably, the electrical active parts are medium voltage or high voltage parts. The term "medium voltage" relates to a voltage in the range of 1 kV to 72 kV; the term "high voltage" refers to a voltage of more than 72 kV. While these are preferred electrical active parts in the frame of the present invention, the parts may also e low voltage parts with a voltage below 1 kV being concerned.

In the frame of the present invention, the singular is intended to include the plural, and vice versa.

It has to be noted that the electrical active parts of the invention can be "stand alone" parts, or they can be part of an assembly of parts, e.g. of an apparatus. This will now be explained in detail.

The electrical active part can be a switch, for example, a fast acting earthing switch, a disconnector, a load-break switch or a puffer circuit breaker, in particular a medium-voltage circuit breaker (GIS-MV), a generator circuit breaker (GIS-HV), a high voltage circuit breaker, a bus bar a bushing, a gas-insulated cable, a gas-insulated transmission line, a cable joint, a current transformer, a voltage transformer or a surge arrester.

The electrical active part may also be part of an electrical rotating machine, a generator, a motor, a drive, a semiconducting device, a computing machine, a power electronics device or high frequency parts, for example, antennas or ignition coils.

The method of the invention is especially suited for medium voltage switchgears and high voltage switchgears.

In the electrical active part, the insulating gas is preferably at a pressure of equal to or greater than 0.1 bar (abs.). The insulating gas is at preferably a pressure equal to or lowers than 30 bar (abs). A preferred pressure range is from 1 to 20 bar (abs.).

The partial pressure of compound of formula (I) depends, i.a., upon its concentration in the isolating gas. If the dielectric isolating gas consists of compound of formula (I), its partial pressure is equal to the total pressure and corresponds to the ranges given above. If the dielectric gas includes an inert gas, the partial pressure of compound of formula (I) is correspondingly lower. A partial pressure of compound of formula (I) which is equal to or lower than 10 bar (abs) is preferred.

In a preferred embodiment, the insulating gas comprises compound of formula (I) and an inert gas. The term "inert gas" denotes a gas which is non-reactive under the conditions in the electrical active parts. For example, any other dielectric insulating gas may be applied as "inert gas" additionally to the content of compound of formula (I).

It is preferred that the composition of the dielectric insulating gas and especially that the content of compound of formula (I) in the inert gas is such that under the climate conditions or the temperature in the ambience of the electrical apparatus, under the pressure in the electrical part, essentially no condensation of the components in the dielectric insulating gas occurs. The term "essentially no condensation" denotes that at most 5% by weight, preferably at most 2% by weight, of the dielectric insulating gas condenses. For example, the amounts of compound of formula (I) the kind and amount of inert gas are selected such that the partial pressure of compound of formula (I) is lower than the pressure where condensation of compound of formula (I) is observed at −20° C.

In another preferred embodiment, the insulating gas comprises compound of formula (I) and air or synthetic air.

In the insulating gas, the content of compound of formula (I) is preferably equal to or greater than 1% by volume. In the insulating gas, the content of compound of formula (I) is preferably equal to or lower than 30% by volume. In a particular embodiment the insulating gas further comprises SF6, preferably in an amount from 0.5% to 20% by volume, more preferably 1% to 10% by volume relative to the volume of the insulating gas.

In the different embodiments described here before the balance to 100% by volume can be inert gas. In another aspect of the different embodiments described here before, the balance to 100% by volume is air or synthetic air.

Most preferably, the content of compound of formula (I) in the dielectric insulating gas is from 5 to 25% by volume. Preferably, the inert gas is selected from the group consisting of nitrogen and helium. Nitrogen as inert gas is especially preferred, and the insulating gas of the present invention consists essentially of compound of formula (I), optionally SF6 and nitrogen.

Another object of the invention concerns a gas mixture, as herein described, comprising a compound of formula $$Rf1\text{-}(O)x\text{-}Rf2 \quad (I)$$

wherein Rf1 and Rf2 are identical or different and designated fluorocarbon residues having a H/F ratio of equal to or less than 0.5 and x is 1, 2, or 3 and an air or an inert gas, preferably argon, helium or nitrogen, more preferably nitrogen.

Still another object of the invention concerns a gas mixture, as herein, described, comprising a compound of formula $$Rf1\text{-}(O)x\text{-}Rf2 \quad (I)$$

wherein Rf1 and Rf2 are identical or different and designated fluorocarbon residues having a H/F ratio of equal to or less than 0.5 and x is 1, 2, or 3, SF6 and an inert gas or air.

Another object of the present invention concerns the use of compound of formula (I) or of the gas mixtures according to the invention, as herein described, as dielectric insulating gas or as constituent of a dielectric insulating gas.

Should the disclosure of any patents, patent applications, and publications which are incorporated herein by reference conflict with the description of the present application to the extent that it may render a term unclear, the present description shall take precedence.

The following examples further explain the invention without intention to limit it.

EXAMPLE 1

Manufacture of $CF_3$—O—O—$CF_3$ $CF_3$—O—O—$CF_3$ is manufactured as described in Example 3 of US-A-2007/0049774.

EXAMPLE 2

Manufacture of Dielectric Insulating Gases

As described in WO98/23363, a homogenous mixture consisting of $CF_3$—O—O—$CF_3$ and $N_2$ in a volume ratio 1:4 is manufactured in an apparatus comprising a static mixer and a compressor.

EXAMPLE 3

Provision of an Earth Cable Containing the Dielectric Insulating Gas of Example 2

The gas mixture of example 2 is directly fed into an earth cable for high voltage, until a total pressure of 10 bar (abs) in the cable is achieved.

EXAMPLE 4

A Switchgear Containing $CF_3$—O—O—$CF_3$ and $N_2$ in a Volume Ratio 1:4

A switchgear is used which contains a switch surrounded by a gas tight metal case. The gas mixture of example 2 is passed into the gas tight metal case via a valve until a pressure of 18 bar (abs) is achieved.

EXAMPLE 5

Provision of a Gas-Insulated Transmission Line Containing the Dielectric Insulating Gas of Example 3

The gas mixture of example 2 is directly fed into an earth cable for high voltage, until a total pressure of 10 bar (abs) in the cable is achieved.

The invention claimed is:

1. A method for dielectrically insulating an electrical active part, the method comprising arranging the electrical active part in a gas-tight housing comprising an insulating gas which contains a compound of formula (I)

$$Rf1\text{-}(O)_2\text{—}Rf2 \quad (I)$$

wherein Rf1 and Rf2, which are identical or different, are each independently selected from the group consisting of perfluorinated ethyl, perfluorinated n-propyl and perfluorinated isopropyl.

2. The method of claim 1 wherein the compound of formula (I) has an atmospheric boiling point of less than 20° C.

3. The method of claim 2, wherein the compound of formula (I) has an atmospheric boiling point of equal to or lower than 0° C.

4. The method of claim 1 wherein the insulating gas comprises the compound of formula (I) and an inert gas.

5. The method of claim 4 wherein the inert gas is selected from the group consisting of nitrogen, argon and helium.

6. The method of claim 1 wherein the insulating gas comprises the compound of formula (I) and air or synthetic air.

7. The method of claim 1 wherein the content of compound of formula (I) in the insulating gas is from >1 to 80% by volume.

8. The method of claim 7 wherein the content of compound of formula (I) in the insulating gas is from 5 to 25% by volume.

9. The method of claim 1 wherein the insulating gas further comprises SF6.

10. The method of claim 9 wherein SF6 is in an amount from 0.5% to 20% by volume relative to the volume of the insulating gas.

11. The method of claim 10 wherein SF6 is in an amount from 1% to 10% by volume relative to the volume of the insulating gas.

12. The method of claim 1 wherein the insulating gas is at a pressure from equal to or greater than 0.1 bar (abs.) to equal to or lower than 30 bar (abs).

13. The method of claim 1 wherein the electrical active part is an electrical apparatus or part of an electrical apparatus which is selected from the group consisting of medium and high voltage apparatus.

14. The method of claim 1, wherein the content of compound of formula (I) in the insulating gas is equal to or greater than 1% by volume relative to the volume of the insulating gas.

15. The method of claim 1, wherein the insulating gas consists of the compound of formula (I).

16. A gas mixture comprising a compound of formula (I)

$$Rf1\text{-}(O)_2\text{—}Rf2 \quad (I)$$

wherein Rf1 and Rf2, which are identical or different, are fluorocarbon residues having a H/F ratio of equal to or less than 0.5; and air or synthetic air.

17. A dielectric insulating gas comprising the gas mixture of claim 16.

18. A gas mixture comprising a compound of formula (I)

$$Rf1\text{-}(O)_2\text{—}Rf2 \quad (I)$$

wherein Rf1 and Rf2, which are identical or different, are each independently selected from the group consisting of perfluorinated ethyl, perfluorinated n-propyl and perfluorinated isopropyl;

and an inert gas or air.

* * * * *